US010442656B2

(12) United States Patent
Zuanigh

(10) Patent No.: US 10,442,656 B2
(45) Date of Patent: Oct. 15, 2019

(54) WIRE-WINDING MACHINE AND METHOD FOR WINDING A REEL WITH JUXTAPOSED COILS

(71) Applicant: CZ TECHNOLOGY S.R.L., Monticello Conte Otto (IT)

(72) Inventor: Lisa Zuanigh, Monticello Conte Otto (IT)

(73) Assignee: CZ TECHNOLOGY S.R.L., Monticello Conte Otto (IT)

( * ) Notice: Subject to any disclaimer, the term of this patent is extended or adjusted under 35 U.S.C. 154(b) by 0 days.

(21) Appl. No.: 16/095,943

(22) PCT Filed: Apr. 26, 2017

(86) PCT No.: PCT/IB2017/052415
§ 371 (c)(1),
(2) Date: Oct. 24, 2018

(87) PCT Pub. No.: WO2017/187366
PCT Pub. Date: Nov. 2, 2017

(65) Prior Publication Data

US 2019/0144233 A1 May 16, 2019

(30) Foreign Application Priority Data

Apr. 26, 2016 (IT) ..... 102016000042599

(51) Int. Cl.
*B65H 54/28* (2006.01)

(52) U.S. Cl.
CPC ..... *B65H 54/2854* (2013.01); *B65H 54/2851* (2013.01); *B65H 2701/36* (2013.01)

(58) Field of Classification Search
None
See application file for complete search history.

(56) References Cited

FOREIGN PATENT DOCUMENTS

| | | | | |
|---|---|---|---|---|
| JP | 3677130 | * | 7/2005 | ..... B65H 54/28 |
| WO | WO 2008/125965 | * | 10/2008 | ..... B65H 5/28 |

* cited by examiner

*Primary Examiner* — Sean Shechtman
(74) *Attorney, Agent, or Firm* — Mark M. Friedman

(57) ABSTRACT

A wire-winding machine comprises a station for winding the wire into a reel comprising a spindle rotatable around an axis of rotation to draw the wire and a spool removably anchored on said spindle and enclosed between a starting stroke flange and an end stroke flange for winding the wire into a reel, and a counteracting tool adapted to operate against the last wound coil to keep the coils mutually juxtaposed. The counteracting tool is controlled by electrical moving means adapted to move it linearly and axially in the winding direction of the coils with a predetermined pitch for each revolution of the spindle.

5 Claims, No Drawings

WIRE-WINDING MACHINE AND METHOD FOR WINDING A REEL WITH JUXTAPOSED COILS

TECHNICAL FIELD

The present invention finds its application in the field of the machine for handling wires, cable and the lie and relates to a winding machine for producing wire reels. The invention also relates to a method for winding wires in reels with juxtaposed coils.

STATE OF THE ART

The known wire winding machines, in particular those used for winding welding wire, are generally designed to draw a continuous wire from a relatively large spool or thread wrap provided by the manufacturer thereof.

In particular, the machines are provided with a winding station with a rotating spindle adapted to drag the wire and wind it on the reel designed to be mounted on the welding machine.

The welding wire, produced in several alloys and diameters, can be wound on supports of various types, sizes, shapes or materials, generally iron baskets or plastic coils.

Wire winding may be carried out according the so-called "random" mode, or according the "juxtaposed coils" or "coil-to-coil" mode.

This second method is increasingly used because it guarantees a safe product quality and enhances its aesthetic appearance.

In the case of a winding machine equipped with a metal basket, either manual, semi-automatic or automatic, the basket is enclosed in a special equipment mounted on the winding spindle and consisting in a core with two flanges.

One of the two flanges can be mechanically or electrically adjustable, for example by means of a motor and encoder or similar means, so that the distance between the two flanges corresponds to a determined measure.

As matter of fact, the winding in the "juxtaposed coils" or "coil-to-coil" mode is carried out in such a way that the distance between the two flanges corresponds to the space occupied by an integer number of coils plus a distance at least equal to half a diameter of the wire.

In automatic machines, there is an automatic adjustment of the position of the flanges by means of electronic metering systems and a coil biasing device operated by a pneumatic cylinder acting on the coils so as to keep them compact.

In manual or semiautomatic machines, the adjustable flange is constructed so that the opening and closing adjustment can be mechanically enabled by locking it in position.

In addition to this adjustment, it is also necessary to adjust the locking system of the spindle's hub to prevent the side thrust exerted by the wire causes also a minimum opening of the flange, eliminating the coil-to-coil winding.

Consequently, if winding at the end of the first layer requires a slight opening or closing adjustment, the operator must first loosen the block on the movement of the hub of the spindle, then adjust the movable flange, block its adjusted position and reposition the block of the hub.

A standard working requires that an operator performs these operations several times a day, resulting in increased workloads and reduced productivity.

In addition, these machines require the presence of a complex spindle structure, therefore more expensive and less reliable.

These issues are even more accentuated if the machine mounts plastic reels.

First of all, while the baskets do not vary between random production and coil-to-coil production, two different types of plastic reels are provided for the two workings.

In particular, the reels for winding juxtaposed coils are more expensive than random winding reels and therefore, in order to avoid unnecessary costs, it is important to avoid using the first type of random winding reel, for example by finishing the reel in random mode if at some point the difficulties are noticeable or you are losing too much time with continuous reverse gear.

In these situations, as the two flanges of the reel cannot be removed, to adapt their distance to the requirements of the wire being worked, the solution is to compress the coil.

However, with wires having lower diameter, such as 0.8 mm, a tight lock may cause excessive deformation of the reel so as not to allow winding in the juxtaposed coils mode. In addition, there is a risk that the coil will break, possibly even after storage for a few days in the warehouse due to accumulated tensions.

In order to partly overcome these drawbacks, two types of reels with different widths (89.9 and 90.4 mm) are used on manual or semiautomatic machines, with obvious complications in handling different orders and in storage in addition to the need for more space around the machine for storing different reels.

Wire winding is carried out with the operator who accompanies the first layer by pressing the coils with a special tool.

When there are one or two coils for inversion, the machine stops for verifying the remaining space, beating transversely with the same tool on the wound coils, possibly turning the spindle forward and backward with the hands to enlarge them and get the proper space at the point opposite to the starting point, generally at least half the wire diameter or even slightly more.

It is obvious that this operating mode is rather long and complex, as well as unsafe, and therefore has low productivity and requires the presence of specialized operators.

SCOPE OF THE INVENTION

The object of the present invention is to overcome the above mentioned drawbacks by providing a wire winding machine which is particularly effective and with increased productivity compared to known type machines.

A particular object is to provide a wire winding machine which allows for a quick and easy adjustment of the pitch of the coils.

Another object is to realize a wire winding machine that allows to increase productivity by eliminating machine stops and reducing the same time the workload for operators. Yet another object is to provide a wire winding machine that is safer, without requiring manual intervention by the operator.

Yet another object is to provide a wire winding machine that does not require high specialization for the operators.

Yet another object is to realize a wire winding machine having a spindle of simpler construction and therefore being cheaper, more reliable and easier to maintain.

These objects, as well as others that will become more apparent hereinafter, are achieved by a wire winding machine which, according to claim 1, comprises a station for winding a wire into a reel, wherein said winding station comprises a spindle rotating about an axis of rotation for dragging the wire to be wound and a sprocket that is removably anchored to said spindle and enclosed between a starting stroke flange and an end stroke flange for winding said wire into a reel, a counteracting tool adapted to operate against the last wound coil to keep the coils juxtaposed.

The counteracting tool is driven by electrical motion means adapted to move it linearly in an axial direction in the winding direction of the coils with a predetermined pitch at each turn of said spindle.

In this way, it will be possible to force the coils to settle properly and to obtain, at the end of the first layer, at the point corresponding to the point opposite to the starting point, a free space at least equal to half a diameter of the wire.

Therefore, on a manual or semi-automatic winding machine, no further corrections will be necessary.

In fact, unlike the pneumatic devices, the wires will not control the displacement of the counteracting tool, that would result in the risk that the coils will not wound properly. According to a further aspect of the invention, there is provided a method for winding a reel with juxtaposed coils according to claim 5.

Advantageous embodiments of the invention are obtained according to the dependent claims.

BEST MODE OF CARRYING OUT THE INVENTION

A winding machine according to the invention may be essentially configured as any rewinder machine commonly used for winding into a reel a continuously wound wire starting from a large sleeve or reel, such as the reels provided directly by the wire manufacturers.

A preferred embodiment provides that the machine is used to wind welding wire in relatively small weight reels, usually between 1 Kg and 18 Kg, designed to be mounted on welding machines.

The machine may be completely manual, or semi-automatic or automatic.

The machine according to the invention may comprise a continuously unwinding station of a wire drawn from a sleeve or reel or alternatively the wire may be taken directly from a reel or sleeve.

The machine further comprises a station for winding coil into a reel which generally comprises a spindle having a motorized rotation axis, usually horizontal, on which a spool is mounted to be rotated by the spindle in order to produce the winding of the wire and form the reel.

The technical features of the spool are not essential for the purpose of the present invention and will therefore not be described in more detail.

More precisely, the spool may be either a metal basket or a plastic reel of any size typically available on the market.

The spindle comprises a countertop that prevents the spool from slip axially and will be removed once the reel winding has been completed for its removal together with the spool.

In a typical way for juxtaposed coil winding machines, the spool is enclosed between a pair of opposing flanges adapted to keep the coils of the winding reels packed therebetween.

According to a peculiar feature of the invention, the two flanges may be placed at a reciprocal distance of known value depending on the size of the spool without any need for adjustment during the winding step as will be apparent hereinafter.

Inside the winding station, a counteracting tool, such as a blade, plate or disc, is arranged to be brought into contact with winding coils to operate against the last wound coil and exert a thrust of sufficient and adjustable intensity to maintain the coils juxtaposed and compact therebetween.

The counteracting tool is driven by electric moving means, such as a stepper motor or other motor, adapted to allow the linear movement of the tool in the axial direction and according to the winding direction of the coils with a predetermined pitch at each turn of the spindle.

In particular, the electric moving means are programmed to move the tool with such a pitch as to define a first layer of coils separated from the end stroke flange with a distance at least equal to half the diameter of the wire and less than the wire diameter, so that the second coils layer and all subsequent coil layers may overlap the immediately underlying layers in the correct position.

Moreover, the electric moving means are adapted to transmit to the counteracting tool an adjustable resistant torque acting against to the displacement that the winding wire exerts on the same tool.

Such resistant torque may only be applied to a predetermined portion of the first winding coil layer.

In this first section, adjustable, the machine may calculate, by means of calculation connected to the moving means, the actual diameter of the winding wire according to the relationship between the covered distance, i.e. the displacement of the tool along the axis of the spindle, and spindle rotations, so as to determine the kept pitch.

At this point, being the distance between the flanges known and fixed, it is possible to calculate the pitch, that is, the linear movement that the tool performs at a precise point of spindle rotation and that from this point onwards it will be necessary to maintain to get the desired final space.

The space over the half diameter of the wire will be absorbed by dividing it between all the wound coils, thus representing an absolutely negligible error.

Alternatively, it is also possible to determine, by analytically calculating it, the appropriate pitch to be kept from the first to the last spin of the spindle by adjusting all the first layer with appropriate positions.

A further operational advantage resulting from the locking of the position of the flanges lies in the fact that in the winding step of the first reel or of a control reel it will be possible to calculate the pitch that the coils have to keep in order to recover the distance from the end stoke flange that would have to be if the wire was wound without guide and with its natural pitch.

In this way, in the windings of the successive coils, it will be possible to accompany the wire with the tool only for the first coils so that the distance is completely covered by the first coils, and then the tool will be retracted to release the wire and allow it to wind with its natural pitch, making the winding step particularly quick.

The machine will be equipped with all the other devices required for the production of the reels, such as thread guides, whose position adjusted in different sections according to different requirements of compacting or enlarging the coils, or even cutting means arranged at the spool to cut the wire at the completion of the reel.

The machine may also be provided with electronic control means adapted to perform a spin counting and to adjust the amount of wire to vary the weight of the second reel.

Furtherly, direct weight measuring means may be provided including a weighing device arranged directly in the winding station and which will be directly coupled to the control means for weighing the second coil directly into the winding station.

In this way, the electronic control means will receive information about the weight measured directly from the weighing station to make the necessary adjustments and adjust accordingly the number of revolutions according to the new measured weight.

Weight correction, obtained by setting a new length of wire to be wound, may be carried out either manually by the operator through a machine interface or automatically by a PLC or other electronic control device, depending on the automation degree of the machine.

Pneumatic movements may also be installed to automatically cut and tie the wire at the end of the reel, open the countertop and unload the reel on an unloading device.

The machine according to the invention facilitates the work of the operator to which less maneuver and experience may be required, increasing productivity and increasing the level of safety, since it will not be necessary to intervene manually through the opening of the protective door of the wiring machine.

The operator must only insert the empty spool, whether it is a plastic spool or a metal drum, close the tailstock, bend and hook the wire, close the door and start the process, then engage in other machines until completion and unloading of the reel.

From the foregoing it will be apparent that the invention realizes the foregoing purposes and in particular that of providing a wire winding machine and a winding method of coils particularly efficient and with high-capacity.

The machine and the method according to the invention are subject to numerous modifications and variants which are all within the inventive concept expressed in the appended claims. All details may be replaced by other technically equivalent elements and the materials may be different according to the needs without departing from the scope of the present invention.

The invention claimed is:

1. A wire-winding machine, comprising:

a station for winding the wire into a reel comprising a spindle rotatable around an axis of rotation to draw the wire and a spool removably anchored on said spindle and enclosed between a starting stroke flange and an end stroke flange for winding said wire into a reel;

a counteracting tool adapted to operate against the last wound coil to keep the coils mutually juxtaposed;

wherein said counteracting tool is controlled by electrical moving means adapted to move it linearly and axially in the winding direction of the coils with a predetermined pitch for each revolution of said spindle;

characterized by comprising computation means adapted to calculate the real diameter of the wire being wound and its natural pitch as function of the ratio between the movement of said tool along the axis of said spindle and the number of revolutions of said spindle for the subsequent calculation of said pitch.

2. Machine as claimed in claim 1, characterized in that said electrical moving means are programmed to move said tool with such a pitch as to define a first layer of coils spaced from said end stroke flange with a distance at least equal to half the diameter of the wire and less than the diameter of the wire.

3. Machine as claimed in claim 1 or 2, characterized in that said electrical moving means are adapted to transmit to said counteracting tool a resisting torque with adjustable intensity against the movement that the wound wire exerts on said tool.

4. Machine as claimed in claim 3, characterized in that said resisting torque is applied only for a predetermined portion of the first layer of wounded coils.

5. A method for winding a reel with juxtaposed coils, comprising the following steps: a) winding a wire having a known diameter by a rotatable spindle for a predetermined number of coils juxtaposed between a starting stoke flange and an end stroke flange spaced apart to form a first layer of coils of a reel;

b) calculating the real diameter of said wire as a function of the ratio of the axial stroke of the wounded wire and the number of revolutions of said spindle;

c) measuring the forwarding pitch of said coils as a function of said calculated real diameter;

d) adjusting said pitch as a function of the known distance between the flanges to obtain a first layer of coils spaced from said end stroke flange with a distance at least equal to half the diameter of the wire and less than the diameter of the wire.

* * * * *